United States Patent [19]

Shaw

[11] Patent Number: 4,802,880

[45] Date of Patent: Feb. 7, 1989

[54] LEAPFROG AND FOOTBALL GAME

[76] Inventor: Christopher Shaw, 163 Oakes Drive, Mississauga, Ontario, Canada, L5G 3M2

[21] Appl. No.: 38,603

[22] Filed: Apr. 15, 1987

[51] Int. Cl.[4] ..... A63F 7/06; A63H 11/06

[52] U.S. Cl. ..... 273/94; 273/428; 446/311; 446/486

[58] Field of Search ..... 446/311, 312, 486, 14, 446/308, 309, 491; 273/424, 428, 94 R, 58 R, 61 R, 129 P, 342, 88

[56] References Cited

U.S. PATENT DOCUMENTS

| | | | |
|---|---|---|---|
| D. 30,032 | 1/1899 | Weigelt et al. | 446/311 X |
| 1,548,507 | 8/1925 | Brown | 273/424 X |
| 1,962,927 | 6/1934 | De Bats | 446/14 |
| 2,069,514 | 2/1937 | Wylie | 273/94 R |
| 2,153,957 | 4/1939 | Davis | 446/486 |
| 3,612,528 | 10/1971 | Glass et al. | 446/308 X |

*Primary Examiner*—Mickey Yu

*Attorney, Agent, or Firm*—Eugene J. A. Gierczak

[57] ABSTRACT

A jumping toy having thin flexible convex surface with at least two curved perimetral edge formation where the convex surface is adapted to bear against a second surface, and is manipulatively elastically deformable against a second surface so as to leap therefrom when the convex surface returns to its original shape. Such jumping toy having a representation of a frog in one enbodiment and used in a football game in another embodiment.

11 Claims, 3 Drawing Sheets

LEAPFROG AND FOOTBALL GAME

FIELD OF INVENTION

This invention relates to jumping toys and more particularly to leaping or jumping toys which include elastically deformable material and the representation of an animal, reptile, insect or football mounted thereon.

BACKGROUND TO THE INVENTION

Jumping or leaping toys have been available for many years.

For example, U.S. Pat. No. 847,755 describes a pnematic toy provided with a tube through which air is adapted to be forced into the toy when inflating same and includes a string for closing the tube and serving to effect a return of the toy after jumping.

Furthermore, U.S. Pat. No. 1,538,704 relates to a toy having a resilient member to impact movement to the toy through impact.

Other arrangements may be found in U.S. Pat. No. 2,824,409 which describes a toy having various parts which include a skeleton and feet which co-operate to effect leaping movements.

Moreover, U.S. Pat. No. 2,570,584 describes a leaping frog figure activated by a fluid pressure cylinder.

And finally, U.S. Pat. No. 224,375 discloses a leaping frog toy activated by mechanical spring elements.

However, the construction and inter-relationship of the movable elements present relatively complicated structure incapable of developing any substantial degree of thrust force.

It is an object of this invention to provide a leaping toy having relatively a simple construction capable of imparting a significant thrust force so as to cause the toy to jump.

FEATURES OF THE INVENTION

The broadest aspect of this invention relates to jumping toys having a thin flexible convex surface having at least two curved perimetral edge formation adapted to bear against a second surface, said convex surface manipulatively elastically deformable against said second surface so as to leap therefrom when said convex surface returns to its original shape.

Another aspect of this invention relates to jumping toys having a thin flexible convex surface manipulatively elastically deformable against a second surface so as to present a quadrilateral edge formation when manipulatively deformed, and to leap from said second surface when said convex surface returns to its original shape.

DESCRIPTION OF THE INVENTION

Identical elements have been given identical numbers throughout the figures.

Figure 1:
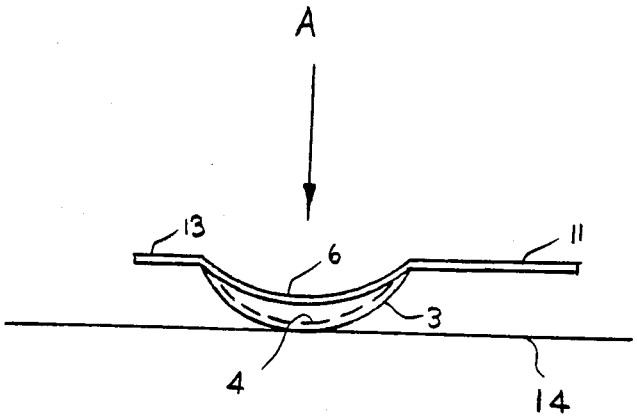
FIG. 1 is a side elevational view of said leaping toy.
Figure 2:
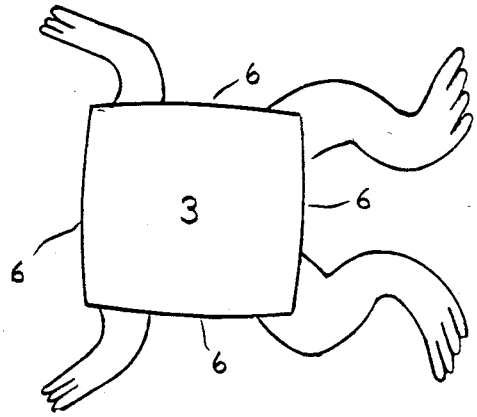
FIG. 2 is a bottom plan view of said leaping toy.
Figure 3:
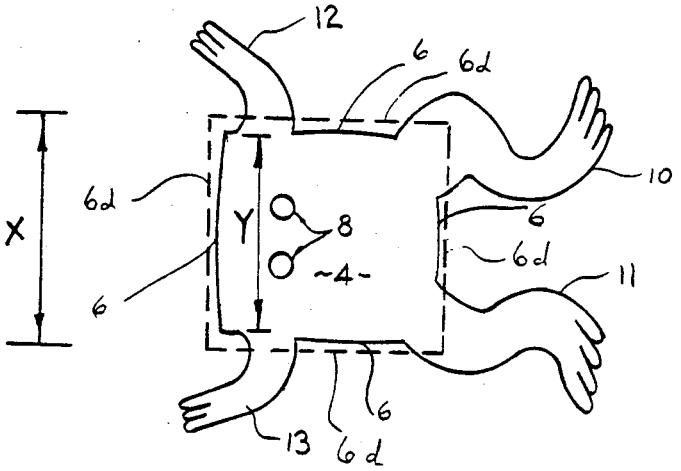
FIG. 3 is a top plan view of said leaping toy.

FIGS. 1, 2 and 3 generally illustrate the jumping toy or leaping frog 2. The jumping toy 2 is comprised of a thin flexible material such as rubber or the like having a convex surface 3 and a concave surface 4 having a generally quadrilateral perimetral edge 6. In the preferred embodiment described herein the perimetral edge 6 presents a square when deformed.

The concave surface 4 may present the representation of an animal, reptile or insect. In the preferred embodiment the concave surface presents a representation of a frog with eyes 8 and legs 10, 11, 12 and 13.

The jumping toy 2 is adapted to bear against a second surface 14 and leap therefrom. In particular, the convex surface 3 is adapted to bear against such second surface 14 and is manipulatively elastically deformable as illustrated in FIG. 4.

Figure 4:
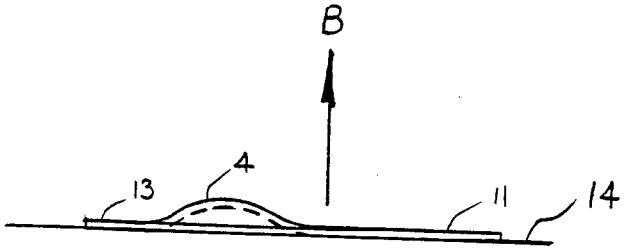
FIG. 4 is a side elevational view of said leaping toy manipulatively elastically deformable against a second surface prior to jumping.

The jumping toy 2 is manipulatively elastically deformable to the position illustrated by the hidden lines **6*d* in FIG. 3 and by FIG. 4 by placing the forefinger and thumb of one hand against the concave surface 4 adjacent legs 10 and 11 respectively and placing the forefinger and thumb of the other hand against the concave surface 4 adjacent legs 12 and 13 respectively and simultaneously pressing both forefinger and thumb downwardly towards the second surface 14 in the direction illustrated by Arrow A in FIG. 1. By manipulatively deforming the toy 2 as described the toy 2 takes on the shape illustrated in FIG. 4 whereby the perimetral edge formation 6 bears against second surface 14 and the convex surface 3 is flexible inverted as to temporarily retain the shape of a concave surface as illustrated in FIG. 4. Such manipulation stores potential thrust energy which causes the toy 2 to leap upwardly in the direction of Arrow B upon release of the fingers and thumb from toy 2**.

Furthermore FIG. 3 illustrates that the perimetral edge formation 6 is displaced to the position marked **6*d* when the jumping toy 2 is manipulatively deformed so as to present a square perimetral edge. Moreover the distance X in the top plan view of FIG. 3 between the corners of the square in the deformed position is greater than the distance Y in the top plan view of FIG. 3** in the original position.

It has been observed that when the jumping toy 2 has been deformed to the position illustrated in FIG. 4 and the forefinger and thumb of each hand are slightly pressed together to move legs 10 and 12 together and legs 11 and 13 together respectively, then there is a slight delay action in the leaping of the toy frog 2 from second surface 14.

Although leaping frog 2 may be constructed from most flexible material it has been found that the leaping frog 2 may be constructed by cutting a tennis ball having a diameter of 6.3 cm (not shown) and applying the eyes 8 and legs 10, 11, 12 and 13 to the concave surface formed therefrom. Various experiments in selection of the configuration of the leaping toy have been undertaken and the results are outlined below. More particularly the tennis ball (not shown) referred to earlier was cut so as to present the following perimetral edges and which resulting surface was manipulatively deformed and the following results observed.

| Observation | Dimension of Perimetril Edge | Result |
|---|---|---|
| 1 | 6 cm diameter | did not jump as surface stretched beyond elastic |

-continued

| Observation | Dimension of Perimetril Edge | Result |
|---|---|---|
| | | limit |
| 2 | 5 cm diameter | did not jump as surface stretched beyond elastic limit |
| 3 | 5 cm diameter | did not invert as the shape was too shallow and there was little elastic stretching |
| 4 | 6 cm by 5 cm Lenticular shape | 70 cm jump |
| 5 | 6 cm by 4 cm Lenticular shape | 20 cm jump |
| 6 | 6 cm by 3 cm Lenticular shape | did not jump as the shape was too shallow and there was little elastic stretching |

Figure 5:
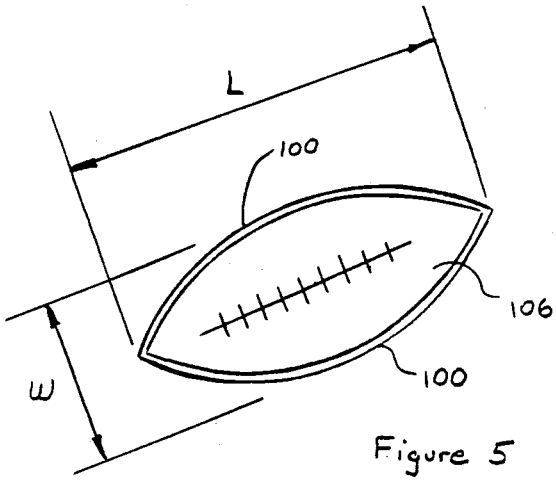
FIG. 5 is a top plan view of a second embodiment of a leaping toy presenting two curved perimetral edges.
Figure 6:
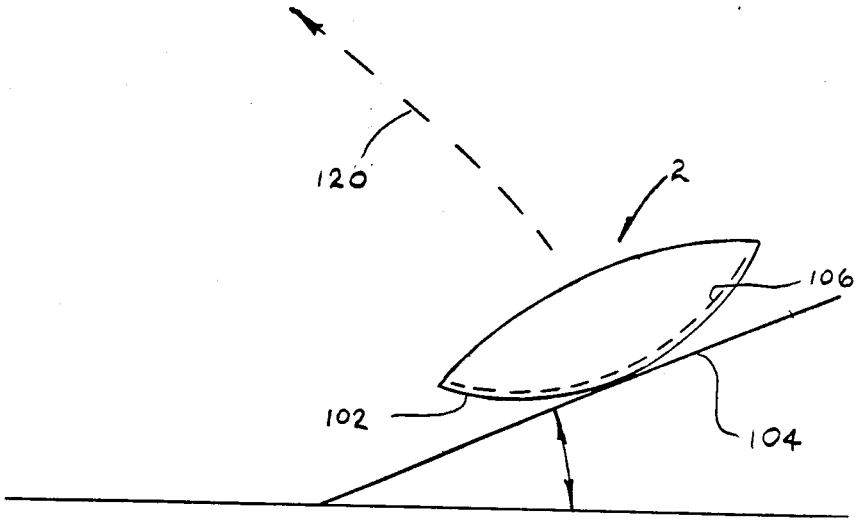
FIG. 6 is a side elevational view of FIG. 5.

The lenticular shape referred to above is best illustrated in FIGS. 5 and 6. The 6 cm dimensions referred to in Observations 4, 5, and 6 refers to the length L while the 5, 4, or 3 cm dimensions refer to the width W of the lenticular shape.

| | | |
|---|---|---|
| 7 | 6 cm distance from corner to corner of a quadrilateral prior to deformation | did not jump as surface stretched beyond elastic limit |
| 8 | 5 cm distance from corner to corner of a quadrilateral prior to deformation | 97 cm jump |
| 9 | 4 cm distance from corner to corner of a quadrilateral prior to deformation | did not invert as shape was too shallow and there was little elastic stretching |

The configuration outlined in observation 7, 8, and 9 were constructed by cutting a tennis ball in half and then taking one sphere and inverting same, and then cutting the periphery of the sphere to present a square edge; such cut sphere was then inverted to its original position and the distances between the corners of the square were measured and presented the 6 cm, 5 cm and 4 cm dimensions referred to in observation 7, 8, and 9.

FIGS. 5 and 6 illustrate the jumping toy 2 having the lenticular shape referred to above. Such jumping toy 2 presents two curved perimetral side edges 100 and a convex surface 102 which is adapted to bear against a second surface 104 and is manipulatively elastically deformable as referred to earlier so as to leap therefrom when the convex surface returns to its original shape.

The jumping toy 2 also presents a concave surface 106 which includes a representation of a football.

The jumping toy 2 having the lenticular shape illustrated in FIGS. 5 and 6 may be used with a surface 104 which is angularly adjustable from the horizontal so as to adjust the parabolic flight path 120 of toy 2.

Such jumping toy 2 illustrated in FIGS. 5 and 6 may then be included in a kit or simulated football game with the adjustable surface 104 and a sheet (not shown) having football yard lines markings marked thereon.

Although the preferred embodiment as well as the operation and use have been specifically described in relation to the drawings, it should be understood that variations in the preferred embodiment could easily be achieved by a man skilled in the art without departing from the spirit of the invention. Accordingly, the invention should not be understood to be limited to the exact form revealed by the drawings.

The embodiments of the invention in which an exclusive proper your privileges your claimed or defined is as follows:

1. A game comprising:

(a) a board having football field representations thereon;

(b) a device moveable relative to said board and having an angularly selectively adjustable surface relative to said board; and (c) a jumping toy having an original stable shape in the form of a thin flexible convex surface with two curved perimetral edge formations, said convex surface adapted to bear against said angularly adjustable surface, wherein said jumping (top) toy is manipulatively elastically deformable against said angularly adjustable surface so as to leap from said angularly adjustable surface when said convex surface returns to its original stable shape to land on said board.

2. A jumping toy as claimed in claim 1 wherein said curved perimetral edge formation together is lenticular in shape.

3. A jumping toy as claimed in claim 2 wherein said concave surface includes a representation of a football.

4. In a game as claimed in claim 1 wherein said jumping toy leaps from said angularly adjustable surface in a parobolic flight path.

5. A jumping toy having a thin flexible convex surface having a perimetral edge presenting four corners therealong manipulatively elastically deformable against a second surface so as to present a quadrilateral edge formation when manipulatively deformed, and to leap from said second surface when said convex surface returns to its original shape, wherein adjacent corners along said perimetral edge are disposed further apart in said deformed position then when said convex surface returns to its original shape said convex surface including felt material.

6. A jumping toy as claimed in claim 5 wherein said quadrilateral perimetral edge formation presents a square when said surface is deformed.

7. A jumping toy as claimed in claim 6 wherein said jumping toy includes a concave surface opposite said convex surface.

8. A jumping toy as claimed in claim 7 wherein said concave surface includes a representation of a frog.

9. A jumping toy having a thin flexible convex surface having a perimetral edge presenting four corners therealong manipulatively elastically deformable against a second surface so as to present a quadrilateral edge formation in the form of a square when manipulatively deformed, and to leap from said second surface when said convex surface returns to its original shape, wherein adjacent corners along said perimetral edge are disposed further apart in said deformed position then when said convex surface returns to its original shape, said convex surface including felt material, and wherein said jumping toy includes a concave surface disposed opposite said convex surface, said concave surface including a representation of a frog.

10. A jumping toy as claimed in claim 9 wherein said concave surface includes felt material.

11. A jumping toy as claimed in claim 10 including frog legs projecting outwardly from said perimetral edge.

* * * * *